United States Patent [19]

Easley et al.

[11] Patent Number: 4,899,796

[45] Date of Patent: Feb. 13, 1990

[54] BALLOON SHADE CONSTRUCTION

[76] Inventors: Madlyn Easley, 75 Brightwood La., West Hartford, Conn. 06110; Robin Fisher, 47 Fieldstone Run, Farmington, Conn. 06032

[21] Appl. No.: 653,317

[22] Filed: Sep. 24, 1984

[51] Int. Cl.[4] ..... A47H 5/00

[52] U.S. Cl. ..... 160/84.1

[58] Field of Search ..... 160/84 R, 330, 344

[56] References Cited

U.S. PATENT DOCUMENTS

| | | | |
|---|---|---|---|
| 1,956,116 | 4/1934 | Carver . | |
| 2,528,652 | 11/1950 | Gundlach . | |
| 2,548,879 | 5/1967 | Druck | 160/330 |
| 2,620,027 | 12/1952 | Eisenberg . | |
| 2,910,120 | 10/1959 | Rosen . | |
| 3,160,202 | 12/1964 | Rosen . | |
| 3,322,182 | 4/1951 | Palella | 160/344 |
| 3,528,477 | 9/1970 | Abraham . | |
| 3,593,772 | 7/1971 | Abraham . | |
| 3,777,800 | 12/1973 | Susoev . | |
| 3,913,655 | 10/1975 | Ogino . | |
| 3,952,788 | 4/1976 | Scholer . | |
| 3,999,590 | 12/1976 | Koch . | |
| 4,069,857 | 1/1978 | Brookshire . | |
| 4,088,170 | 5/1978 | Franklin . | |
| 4,397,346 | 8/1983 | Chumbley et al. . | |

*Primary Examiner*—Blair M. Johnson
*Assistant Examiner*—Robert A. Olson
*Attorney, Agent, or Firm*—Ira S. Dorman

[57] ABSTRACT

A balloon-type shade utilizes bands of low-friction material, attached to a flap on the shade, for guiding the drawstrings at their points of directional change from vertical to horizontal. This permits the shade to be prestrung, independently of any rigid mounting rod, and thereby enables shipment in a flat, folded condition.

12 Claims, 3 Drawing Sheets

BALLOON SHADE CONSTRUCTION

BACKGROUND OF THE INVENTION

So-called "balloon" shades are currently enjoying considerable popularity as window treatments, particularly for home decoration use. Structurally, such shades consist of a panel of supple fabric, to the back of which a number of rings or similar elements are secured in a pattern of columns and rows. The rings serve to guide several drawstrings from points of attachment near the bottom to points near the top, and then across the shade to a common location adjacent one side, for simultaneous operation. The shades are designed to be hung from an overhead rod, and will usually have a stiffening strip inserted along the bottom edge to help maintain proper conformation.

Heretofore, it has been the practice to affix the uppermost guide elements directly to the rigid supporting rod, to ensure that the attachment will be strong enough to avoid disengagement. Drawstring directional changes are effected by those elements, and they are consequently subjected to rather substantial levels of force. In addition, attachment to the rod prevents sliding and gathering of the fabric at the top of the shade, which would otherwise also tend to occur in response to movement of the drawstrings.

A primary disadvantage of the conventional construction resides in the fact that it makes it impossible to string the shade prior to assembly with the supporting rod; prestringing is of course highly desirable from the standpoint of customer convenience and, accordingly, for consumer appeal. Furnishing the shade in prestrung condition, on the rod, would on the other hand hamper standardization of sizes, since the length of the rod must conform to the width of the window on which the shade is to be installed. It would, moreover, virtually preclude mail-order sales, since shipment in a flat (i.e., folded) condition would therefore be rendered impossible.

A considerable variety of shade and curtain constructions is disclosed in the prior art, as evidenced by the following U.S. Pat. Nos. 1,956,116; 2,528,652; 2,620,027; 2,910,120; 3,160,202; 3,528,477; 3,593,772; 3,777,800; 3,913,655; 3,952,788; 3,999,590; 4,069,857; 4,088,170; and 4,397,346. More particularly, in U.S. Pat. Nos. 2,910,120 and 3,160,202, Rosen describes curtains in which drawstrings are threaded through eyelets secured in the area of a hem, and conventional rods are apparently used for supporting the curtains; the cords extend vertically through "tubes" defined by tapes attached to the material of the curtain. In Koch, U.S. Pat. No. 3,999,590, carriers affixed to the curtain are also attached to an overhead rail; the carriers have ring portions which cooperate with loops for guiding the operating cords.

Attempts have been made to design shades of this sort to allow prestringing off the supporting rod, such as by providing fixtures to be subsequently attached to the rod during installation, through which fixtures the cords are threaded by the manufacturer. This has been found, however, to be at best an awkward solution, and to necessitate the use of complex and cumbersome packaging. Thus, despite prior efforts, a need remains for a balloon-type shade which can be furnished in prestrung condition, apart from any supporting rod, and which can be conveniently folded and packaged for shipment.

Accordingly, it is an object of the present invention to provide a novel balloon-type shade which can be furnished in standardized widths, in prestrung condition, and independently of any supporting rod.

It is also an object of the invention to provide such a shade which will operate in a smooth and reliable manner, without undue shifting on the supporting rod.

Another object is to provide a novel balloon shade having the foregoing features and advantages, which is attractive, durable, relatively uncomplicated and inexpensive to manufacture, and easy to install.

SUMMARY OF THE DISCLOSURE

It has now been found that certain of the foregoing and related objects of the invention are readily attained in a prestrung balloon shade, comprising a main panel of supple material, and a strip of such material extending across the top, on one side thereof. Means is provided for attaching the strip to the main panel along at least one laterally extending line, so as to define a rod-receiving sleeve portion thereabove and a marginal portion of the strip therebelow. A plurality of relatively rigid loops are provided, which are affixed to the marginal portion at laterally spaced locations; they are fabricated from a low friction material, and define laterally aligned channels therethrough, which extend along an axis parallel to the plane of the panel. The shade also includes a multiplicity of guide elements which are arranged in rows and columns on the "one" side of the panel, with each column of such elements being aligned under an associated one of the rigid loops. A corresponding plurality of drawstrings are attached to the panel adjacent its lower edge. Each drawstring is threaded through the guide elements of one column, and then through the associated loop at the top; the drawstrings are inserted through the loops in the direction of one side edge of the panel, and all pass through the loop postioned most closely adjacent to that edge.

In the preferred embodiments, the marginal portion of the top strip will comprise a double thicknes of the material. The main panel and strip will most conveniently be provided as integral sections of a single web or piece, the web being folded upon itself along one margin to define the strip, and being folded adjacent its lower edge to provide the double thickness marginal portion to which the loops are affixed.

The attaching means for the shade portions may extend along a second line, parallel to the "one" line and spaced upwardly therefrom, to define the rod-receiving sleeve portion therebetween. The material of the shade will generally be a textile fabric, and the loops will advantageously be fabricated from a synthetic resinous material (e.g., a polyolefin, a polyester, a polyamide, or a polytetrafluoroethylene-type resin) having a low coefficient of friction. Most desirably, the loops will be in the form of relatively wide bands of such a material.

Certain objects of the invention are attained by the provision of a balloon shade assembly comprising, in addition to the shade itself, as hereinabove described, a mounting rod received within its sleeve portion. In such a case, the shade and the rod will be devoid of additional means for attaching them to one another, with the width of the shade being adjustable thereon.

DETAILED DESCRIPTION OF THE ILLUSTRATED EMBODIMENTS

Figure 1:
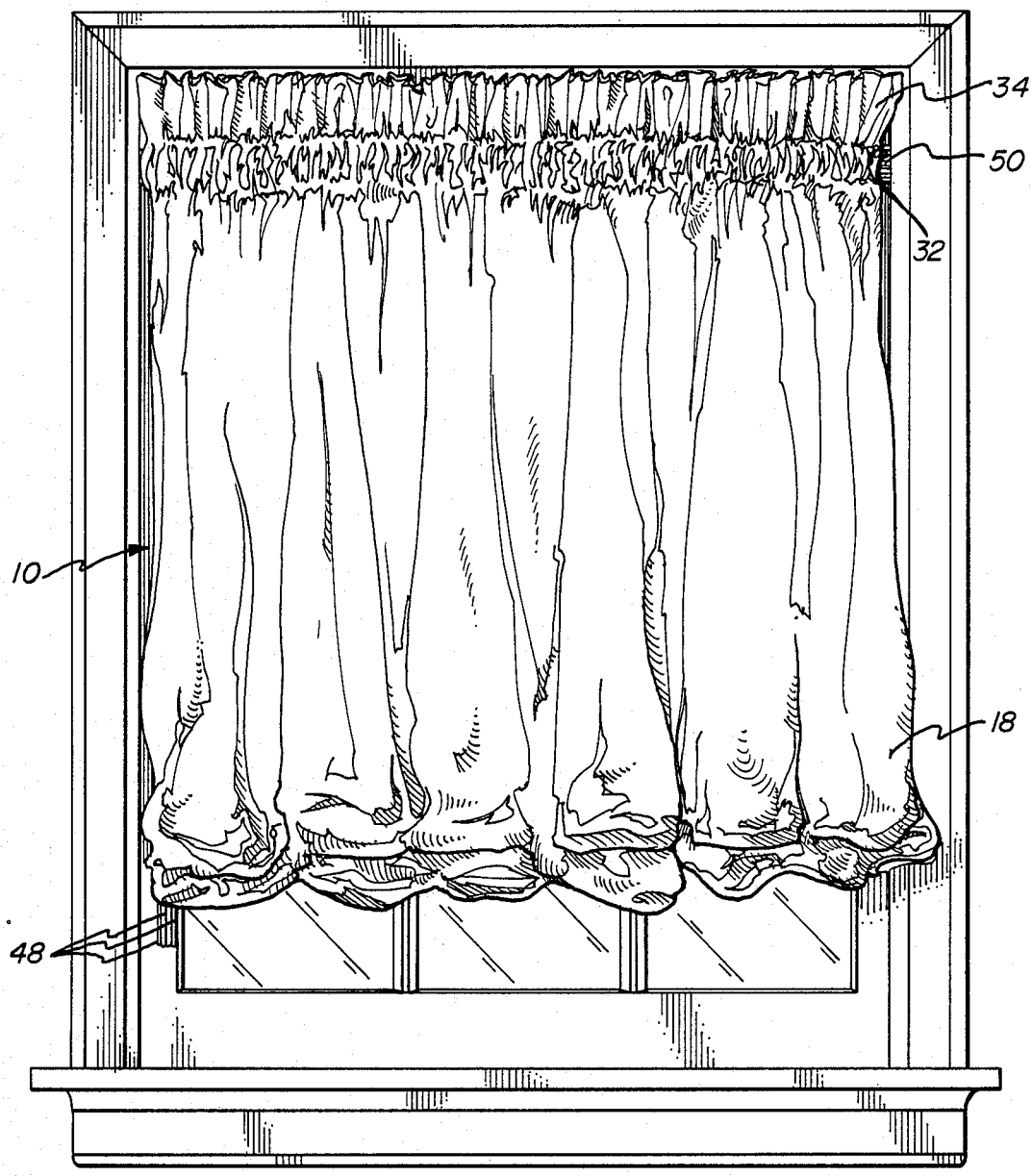
FIG. 1 is an elevational view of a balloon shade assembly embodying the present invention, installed in typical fashion within a window frame.
Figure 2:
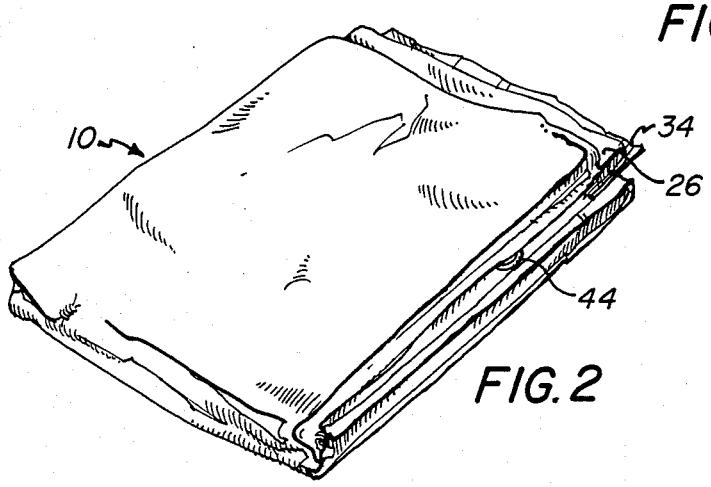
FIG. 2 is a perspective view of the shade utilized in the assembly of FIG. 1, drawn to an enlarged scale and shown in folded, flat condition.
Figure 6:
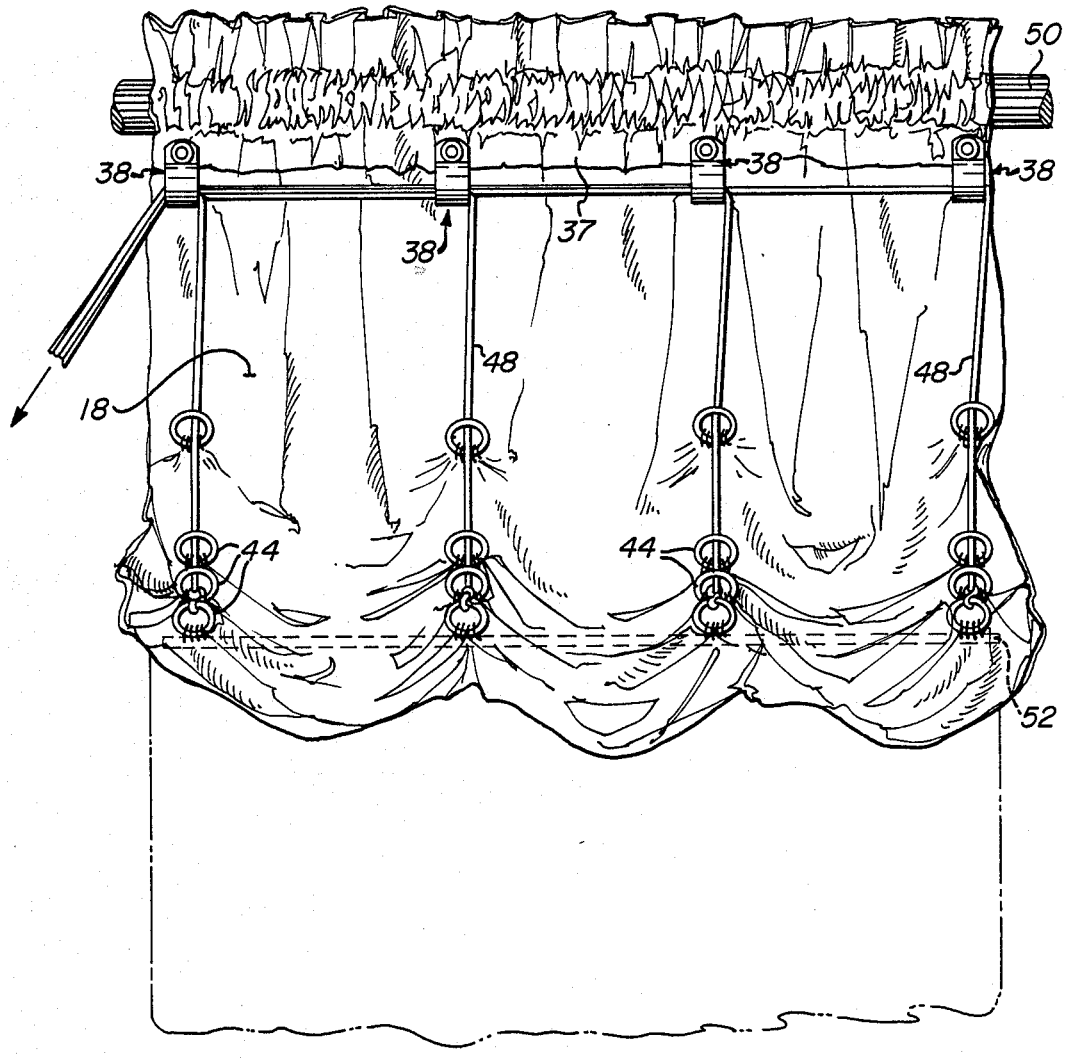
FIG. 6 is a rear view similar to FIG. 1, showing the shade partially elevated and suggesting the window area in phantom line.

Turning now in detail to the appended drawings, a balloon shade assembly embodying the present invention is shown in FIGS. 1 and 6, and the shade itself is depicted in FIGS. 2–5. The shade consists of a rectangular piece of material (usually a textile fabric), generally designated by the numeral 10, folded inwardly upon itself along its sides to provide finished lateral edges 12, and folded downwardly and upwardly upon itself at the top and bottom to provide upper and lower marginal portions 14 and 16, respectively. The lower marginal portion 16 is sewn to the main body portion 18 along two laterally extending parallel lines 20, 22, to define therebetween a lower sleeve pocket 24 and a bottom hem 26.

The upper marginal portion 14 is similarly stitched to the main panel 18 along parallel lines 28, 30, to define an upper sleeve pocket 32 and top hem 34. The lower edge section 36 on the marginal portion 14 is folded upwardly to a position against the main body portion 18, and is held in place between the facing sections by the stitching 30; in this manner, a double thickness of material is provided as a flange or flap 37, along the lower edge of the upper portion 14.

A number of loops, generally designated by the numeral 38, are affixed to the double-thickness flange 37 at spaced locations across the width of the shade. As can be seen, each loop 38 is made from a strip or band of material 40, formed into a generally circular configuration and secured through its end portions to the flange 37 by a pop rivet 40, to provide laterally extending channels 42 across the top of the shade, aligned on an axis parallel to the plane thereof. The material employed for the loops 38 will generally be a low friction synthetic resinous material, such as polyethylene, polypropylene, the polyesters, the polyamides, the polytetrafluoroethylene-type resins, etc., and they should preferably be relatively wide to virtually eliminate any chance of the cords binding as they pass through the channels defined; most conveniently, standard electrical wiring harnesses may be used.

Aligned under each of the loops 38, against the rear surface of the body portion 18, are a number of guide rings 44 arranged (in rectangular, grid-like fashion) in rows and columns; they are most readily fixed in place by stitching them to the fabric, as at 46. A drawstring 48 is threaded through each column of rings 44 (being tied to the lowermost one), and through the associated guide loop 38 at the head of the column. All of the drawstrings are inserted in the same direction, toward a common side edge of the shade, with those to the right of the column that lies along the left-hand margin (as shown in the drawings) also passing sequentially through adjacent loops as they proceed toward the common side edge.

As is best seen in FIGS. 1 and 6, in the installed condition a supporting rod 50 is received through the sleeve pocket 32 at the top of the shade, and is mounted (by means not shown) within the window frame opening, in a conventional manner. They are not otherwise attached to one another, so that the width of the shade can readily be adjusted on the rod. A stiffening strip 52 of appropriate length is inserted into the pocket 24 at the bottom of the shade, and helps to maintain proper conformation.

Figure 3:
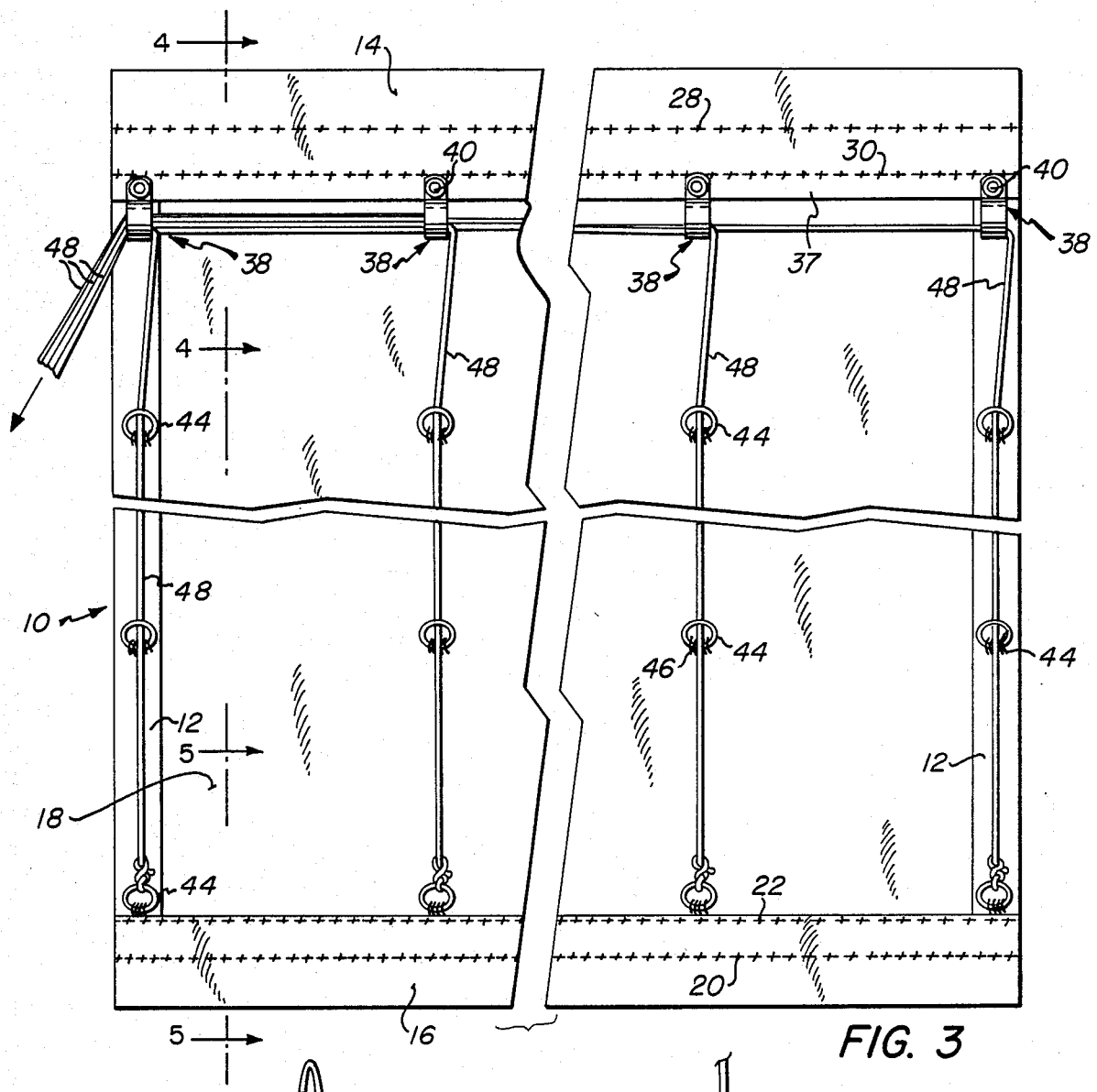
FIG. 3 is a plan view of the rear of the shade of the foregoing Figures, in flat condition.
Figure 4:
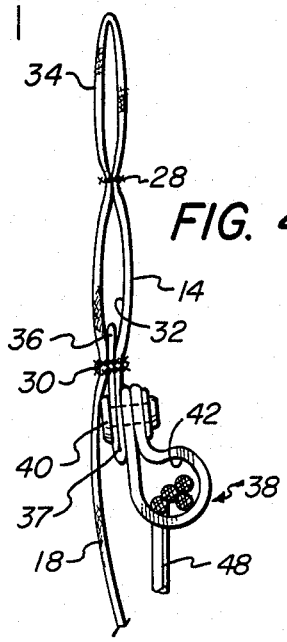
FIG. 4 is a fragmentary sectional view of the top of the shade, taken along line 4—4 of FIG. 3 and drawn to a scale enlarged therefrom.
Figure 5:
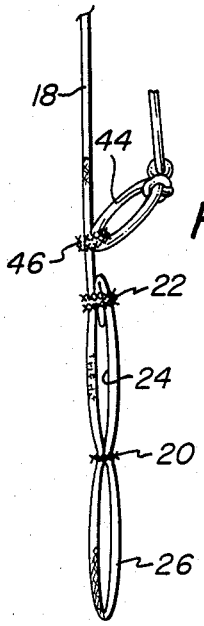
FIG. 5 is a view similar to FIG. 4, taken along line 5—5 of FIG. 3 and showing the bottom portion of the shade.

Operation will be self-evident, and simply entails simultaneously pulling the several drawstrings 48 in the direction indicated by the arrow in FIGS. 3 and 6, thereby exerting lifting force upon the lowermost rings 44 and elevating the shade from the position of FIG. 1 toward that of FIG. 6. The orientation and open configuration of the loops 38, coupled with the rigidity and low-friction character of the material of which they are made, facilitates free and non-binding movement of the drawstrings 48, and thereby ensures smooth and reliable operation of the shade.

Because the loops 38 are attached to the flange 37, rather than to the supporting rod 50, the shade of the invention can be furnished to the customer in a prestrung condition, without the rod and with no concern about precise window dimensions. This manner of attachment also minimizes any tendency for the material to shift on the rod, when the drawstrings are pulled. The double-thickness flap 37 is of course advantageous from the standpoint of conveniently providing desirable reinforcement, to prevent the rivets 40 from tearing from the fabric and thereby causing premature failure of the shade. The use of a single piece of fabric, folded to form the sleeve pockets and the flap for attaching the loops, is also most advantageous from the standpoint of manufacturing economy and simplicity. It is evident that hanging of the shade will be easily achieved, requiring only that the supporting rod be inserted into the sleeve formed in the panel, and then mounted within or upon the window frame in a conventional manner.

Although pop rivets have been shown for affixing the loops, it will be appreciated that other types of fasteners may be substituted. Also, while the several parts of the shade will normally be sewn to one another, since they will usually be made of cloth, other means may be employed where appropriate; for example, if the shade were to be fabricated from a thermoplastic sheet material, heat sealing would be a suitable technique for joining the various sections. Finally, although a one-piece construction has been illustrated, it will be appreciated that the shade may be made from two or more separate pieces, which may be different fabrics or materials, if so desired.

Thus, it can be seen that the present invention provides a novel balloon-type shade which can be furnished in standard widths and in a prestrung condition, apart from any supporting rod. The shade will operate in a smooth and reliable manner, without undue shifting on the rod, and it is attractive, durable, relatively uncomplicated and inexpensive to manufacture, and easy to install.

Having thus described the invention, what is claimed is:

1. A prestrung balloon shade, comprising:

a main panel of supple material;

a strip of supple material extending across the top of said panel on one side thereof;

means for attaching said strip to said main panel along at least one laterally extending line, and defining a rod-receiving sleeve portion thereabove and a marginal portion of said strip therebelow;

a plurality of relatively rigid loops affixed, by relatively non-protruding means, on and depending from said marginal portion of said strip at laterally spaced locations, each of said loops being fabricated from a low friction material, and defining laterally extending channels therethrough, said channels being aligned generally on an axis parallel to the plane of said panel and lying closely adjacent thereto;

a multiplicity of guide elements arranged in rows and columns on said one side of said main panel, each of said columns being aligned under an associated one of said loops; and a corresponding plurality of drawstrings, each attached to said panel adjacent the lower edge thereof and being threaded through said guide elements of one of said columns, and through said associated loop to extend therefrom only in the direction of one side edge of said panel, said drawstrings all being threaded through at least the one of said loops positioned most closely adjacent said one side edge, the suppleness of said material of said main panel and said attached strip allowing intentional gathering thereacross to permit variation in the expanse of said shade when mounted upon a rod received through said sleeve portion thereof.

2. The shade of claim 1 wherein said material is a textile fabric.

3. The shade of claim 1 wherein said attaching means also extends along a second line parallel to said one line and spaced upwardly therefrom, to define said sleeve portion therebetween.

4. The shade of claim 1 wherein said marginal portion of said strip comprises a double thickness of said material.

5. The shade of claim 4 wherein said panel and strip are integral sections of a single web, said web being folded upon itself along one margin to define said strip, and also being folded adjacent the lower edge of said strip to provide said double thickness marginal portion thereof.

6. The shade of claim 1 wherein said loops are relatively wide bands fabricated from a synthetic resinous material.

7. The shade of claim 6 wherein said resinous material is a polytetrafluoroethylene-type resin, a polyolefin, a polyester, or a polyamide resin.

8. A balloon shade assembly including:

(a) a balloon shade comprised of a main panel of supple material, a strip of supple material extending across the top of said main panel on one side thereof, means for attaching said strip to said main panel along at least one laterally extending line, and defining a rod-receiving sleeve portion thereabove and a free marginal portion of said strip therebelow, a plurality of relatively rigid loops affixed, by relatively non-protruding means, on and depending from said marginal portion of said strip at laterally spaced locations, each of said loops being fabricated from a low friction material and defining a laterally extending channel therethrough, said channels being aligned generally on an axis parallel to the plane of said panel and lying closely adjacent thereto, a multiplicity of guide elements arranged in rows and columns on said one side of said main panel, each of said columns being aligned under an associated one of said loops, and a corresponding plurality of drawstrings, each attached to said panel adjacent the lower edge thereof and being threaded through said guide elements of one of said columns, and through said associated loop to extend therefrom only in the direction of one side edge of said panel, said drawstrings all being threaded through at least the one of said loops most closely adjacent said one edge; and (b) a mounting rod received within said sleeve portion of said shade, said shade and rod being devoid of other means attaching them to one another, and the suppleness of said material of said main panel and said attached strip allowing intentional gathering thereacross, said shade thereby being of readily adjustable width on said rod.

9. The assembly of claim 8 wherein said material is a textile fabric, wherein said panel is substantially rectangular, and wherein said guide elements and loops are arranged in a rectangular, grid-like pattern.

10. The assembly of claim 8 wherein said loops are fabricated from relatively wide bands of a synthetic resinous material.

11. The assembly of claim 8 wherein said marginal portion of said strip comprises a double thickness of said material.

12. The assembly of claim 11 wherein said panel and strip are integral sections of a single web, said web being folded upon itself along one margin to define said strip, and also being folded adjacent the lower edge of said strip to provide said double thickness marginal portion thereof.

* * * * *